US006024219A

United States Patent [19]

Froehlich et al.

[11] Patent Number: 6,024,219

[45] Date of Patent: Feb. 15, 2000

[54] DISPLAY PACKAGES

[75] Inventors: Sarah M. Froehlich, Scottsdale, Ariz.; Denise A. Allen, St. Albans, N.Y.

[73] Assignee: Kraft Foods, Inc., Northfield, Ill.

[21] Appl. No.: 09/183,438

[22] Filed: Oct. 30, 1998

[51] Int. Cl.[7] ..... B65D 85/00

[52] U.S. Cl. ..... 206/459.5; 206/776; 220/665

[58] Field of Search ..... 206/459.5, 457, 206/778, 526, 459.1, 776, 777; 229/526, 162, 104; 220/665

[56] References Cited

U.S. PATENT DOCUMENTS

| | | | |
|---|---|---|---|
| D. 317,718 | 6/1991 | Carol | D9/341 |
| 1,955,663 | 4/1934 | Wendell et al. | 229/104 |
| 2,406,254 | 8/1946 | Ringer | 229/104 |
| 3,263,899 | 8/1966 | Collura et al. | 220/222 |
| 3,281,052 | 10/1966 | Michels | 229/222 |
| 3,313,407 | 4/1967 | Palm, Jr. | 206/425 |
| 3,580,483 | 5/1971 | Young | 229/222 |
| 3,688,972 | 9/1972 | Mahon | 206/427 |
| 4,997,104 | 3/1991 | Pohl | 220/403 |
| 5,056,657 | 10/1991 | Frye | 206/494 |
| 5,228,564 | 7/1993 | Randeria | 206/45.14 |
| 5,259,551 | 11/1993 | Davis | 229/162 |
| 5,326,575 | 7/1994 | Spaulding | 426/87 |
| 5,447,269 | 9/1995 | Fultz | 229/120 |
| 5,586,677 | 12/1996 | Foos | 220/260 |

*Primary Examiner*—Paul T. Sewell
*Assistant Examiner*—Nhan T. Lam
*Attorney, Agent, or Firm*—Thomas A. Marcoux; Thomas R. Savoie

[57] ABSTRACT

A display package including an outer container and one or more inner containers housed in the outer container. The outer container is made from a transparent material which is selectively coated to provide both opaque and translucent areas on the surface of the outer container while leaving some transparent areas. The opaque and translucent areas may be used to display indicia about the product whereas the transparent areas provide a view of the inner containers and/or any indicia thereon. A variety of visual effects can be achieved by selecting the appropriate colors and/or transitions between the opaque, translucent and transparent areas of the outer container.

21 Claims, 6 Drawing Sheets

DISPLAY PACKAGES

BACKGROUND OF THE INVENTION

1. Field of the Invention

The present invention relates to a display package, and it relates in particular to such a package having an outer container which houses inner products, the latter being visible through selected areas of the outer container.

2. Brief Discussion of the Prior Art

Display packages are known which employ a window or other transparent area in an otherwise opaque package or which are completely transparent to permit viewing of inner products of the package.

Generally, the design of packages having transparent viewing areas is limited by the physical constraints of having to place the transparent viewing area at locations dictated by the physical requirements of the outer container. For example, transparent windows, whether open or covered by a transparent material, must be placed so as not to interfere with the structural integrity of the outer container. Also, the design of such outer containers may be rendered complex by the added steps of forming the opening in the otherwise opaque material of the outer container, whether or not that opening is covered with a transparent material. These design limitations may also dictate that the viewing areas do not optimally display important aspects of the inner product or that the positioning of the inner product not be optimal, such that important aspects of the inner product would not be in the vicinity of the transparent viewing area.

Also, packages are known wherein at least one surface has areas of opacity and transparency in the material of the package itself, to optimally display one side of an inner product. It is also known to provide completely transparent outer containers for housing inner products. However, completely transparent outer containers lack the opaque and transparent areas needed for aesthetics, to provide adequate areas for indicia and for selectively, optimally displaying only certain aspects of the inner product.

Thus, a need exists for a new and improved package of the type described comprising an outer container housing a plurality of inner products, which package will satisfy the various needs of aesthetics, ease of manufacture and optimal viewing of the inner products, including making visible important aspects of the inner products, while providing adequate opaque and transparent areas on the outer container for aesthetics and display of product indicia information.

SUMMARY OF THE INVENTION

The present invention provides a new and improved display package which overcomes the disadvantages of the prior art. More specifically, the present invention provides a display package of the type having an outer container with inner products, wherein the outer container provides across its various faces selected areas of opacity, transparency and translucency so as to provide a highly aesthetic package while displaying selected important aspects of the inner products, while concurrently providing sufficient translucent and opaque areas for product indicia information.

In accordance with a preferred embodiment of the present invention, the package is a substantially rectangular package containing a plurality of elongated inner products. Preferably, the tops and the bottoms of the outer container would be opaque. The four sides of the container are preferably selectively provided with areas of opacity, translucence and transparency. By properly selecting these respective areas, the package will have a highly attractive appearance, there will be a sufficient translucent or opaque background for adequate presentation of both pictured display information and written indicia. Fully transparent areas can be provided for viewing information on the inner products; and all of the inner products themselves can be visible through some or all of the four sides of the container, either completely through transparent portions or partially, at least the outline thereof, through the translucent portions.

In accordance with another preferred aspect of the present invention, the top of the package is provided with means for opening and reclosing the outer container while the bottom of the package is provided with means such as feet or the like to facilitate standing the package up on its bottom so that the four sides are arranged vertically. Preferably, the package is rectangular, with the smallest opposing ends being the top and bottom, and the inner products being elongated, extending essentially from the top to the bottom within the outer container such that the side portions thereof are adjacent the four sides of the outer container. This arrangement not only allows viewing of the inner products before the package is opened, but it also permits the user to determine the number of inner products remaining after the outer container has been opened and one or more inner products have been removed.

These and other objects and advantages of the present invention will become apparent from the detailed description to follow of preferred embodiments of the invention.

BRIEF DESCRIPTION OF THE DRAWINGS

The present invention will now be described in detail with respect to preferred embodiments thereof, which are to be taken together with the accompanying drawings, wherein.

DETAILED DESCRIPTION OF THE PREFERRED EMBODIMENTS

Figure 1:
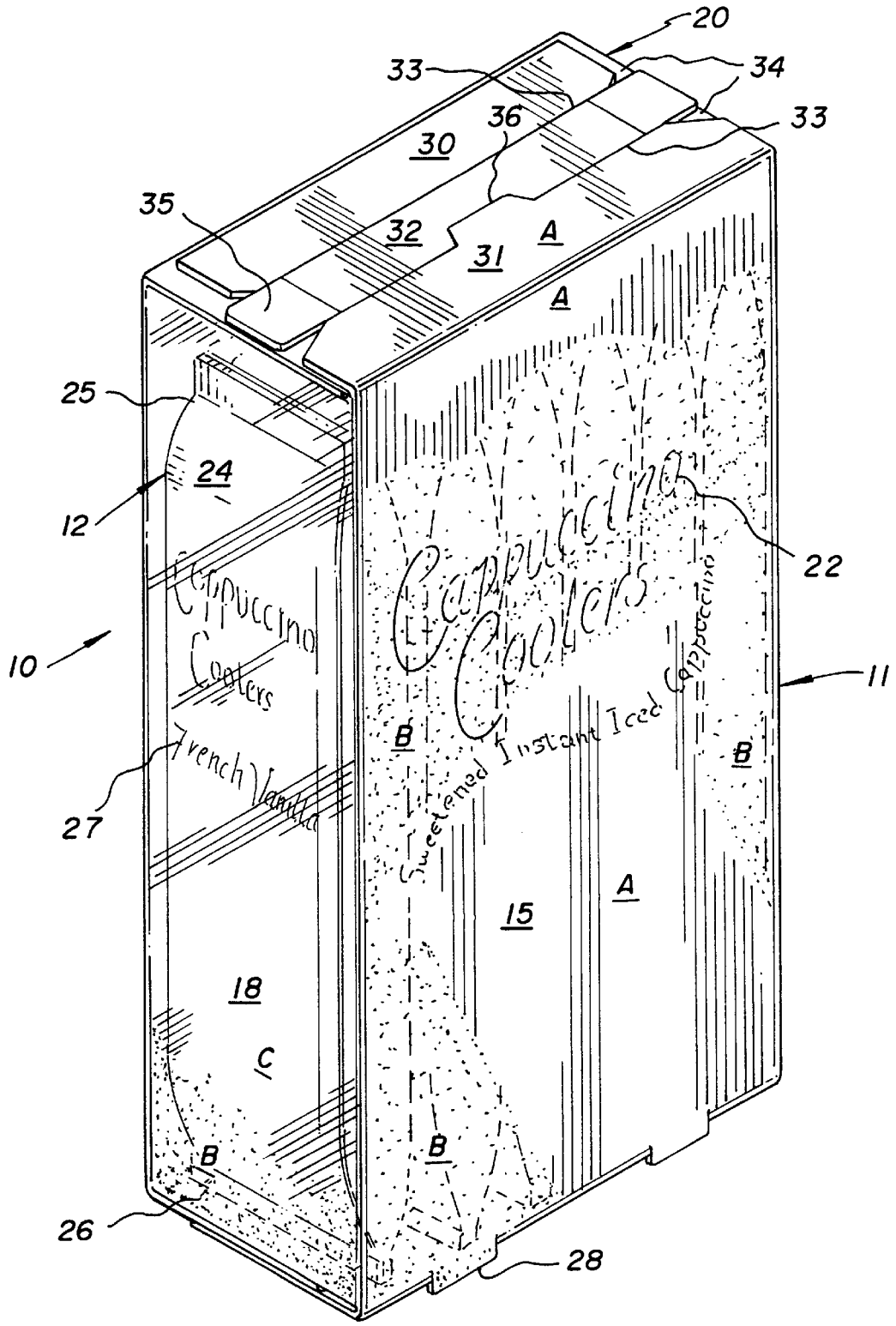
FIG. 1 is a front perspective view from above of the package in accordance with the present invention.
Figure 2:
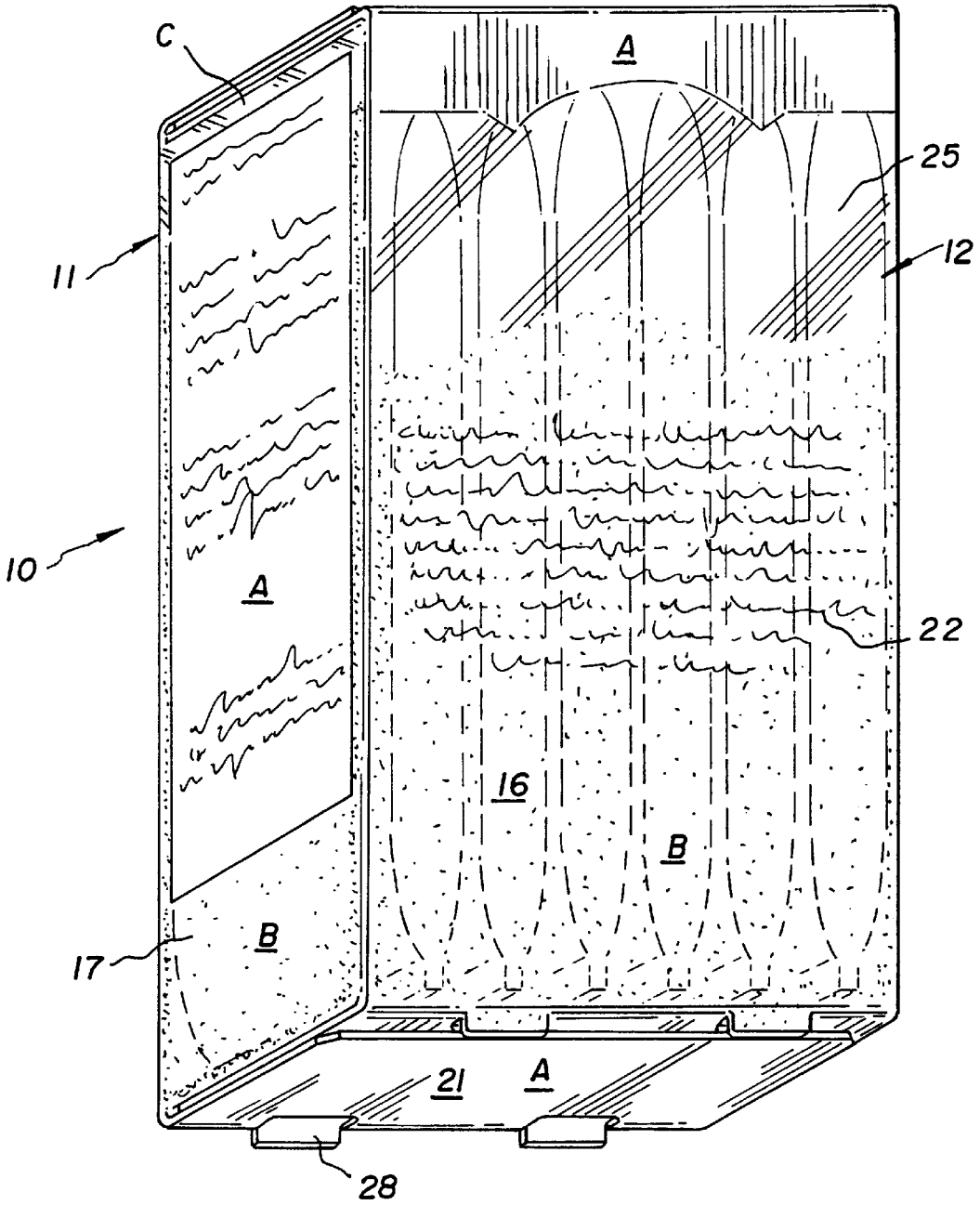
FIG. 2, is a back perspective view from below of the package in accordance with the present invention.
Figure 3:
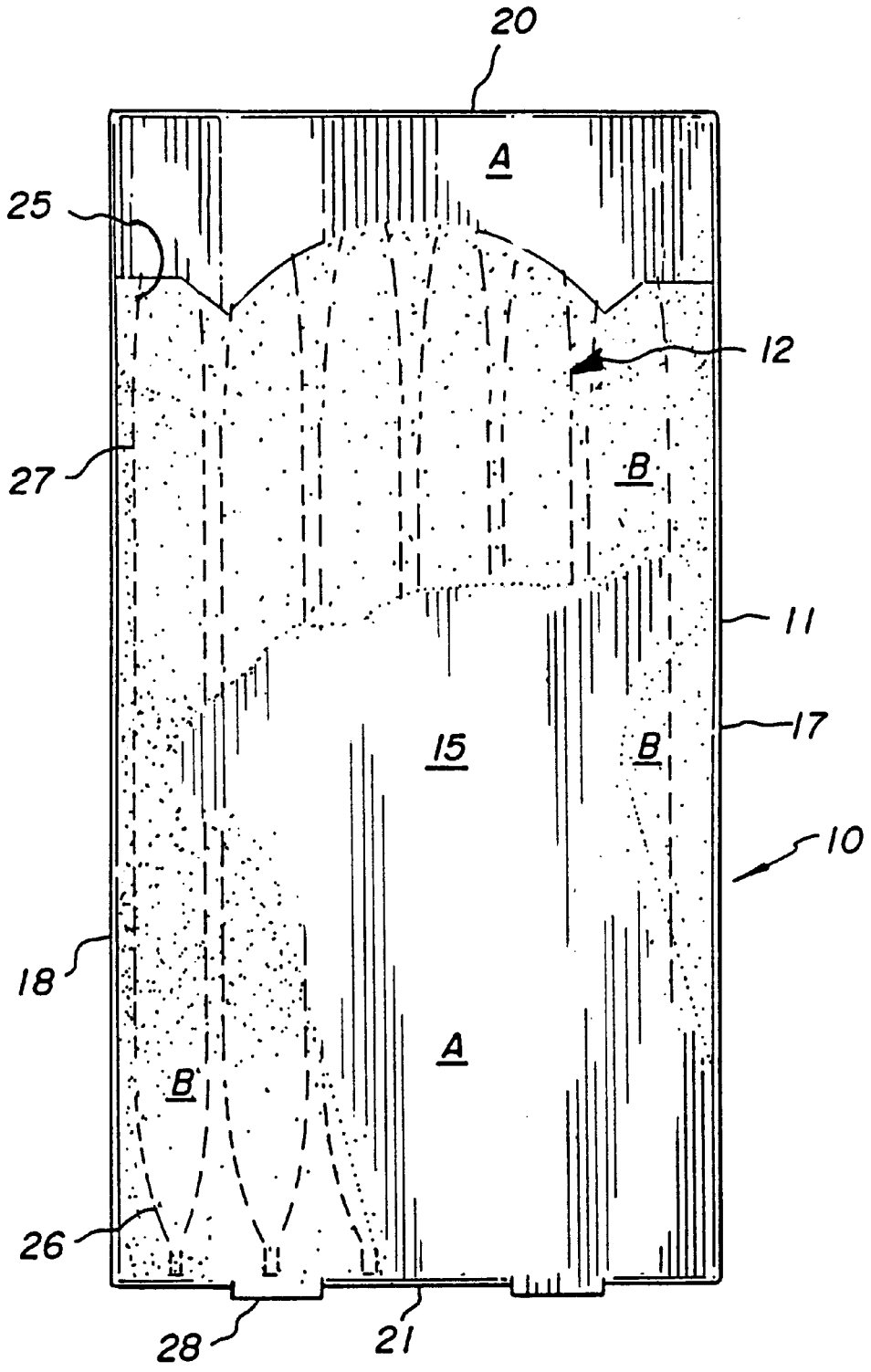
FIG. 3 is a front elevational view of the package in accordance with the present invention.
Figure 4:
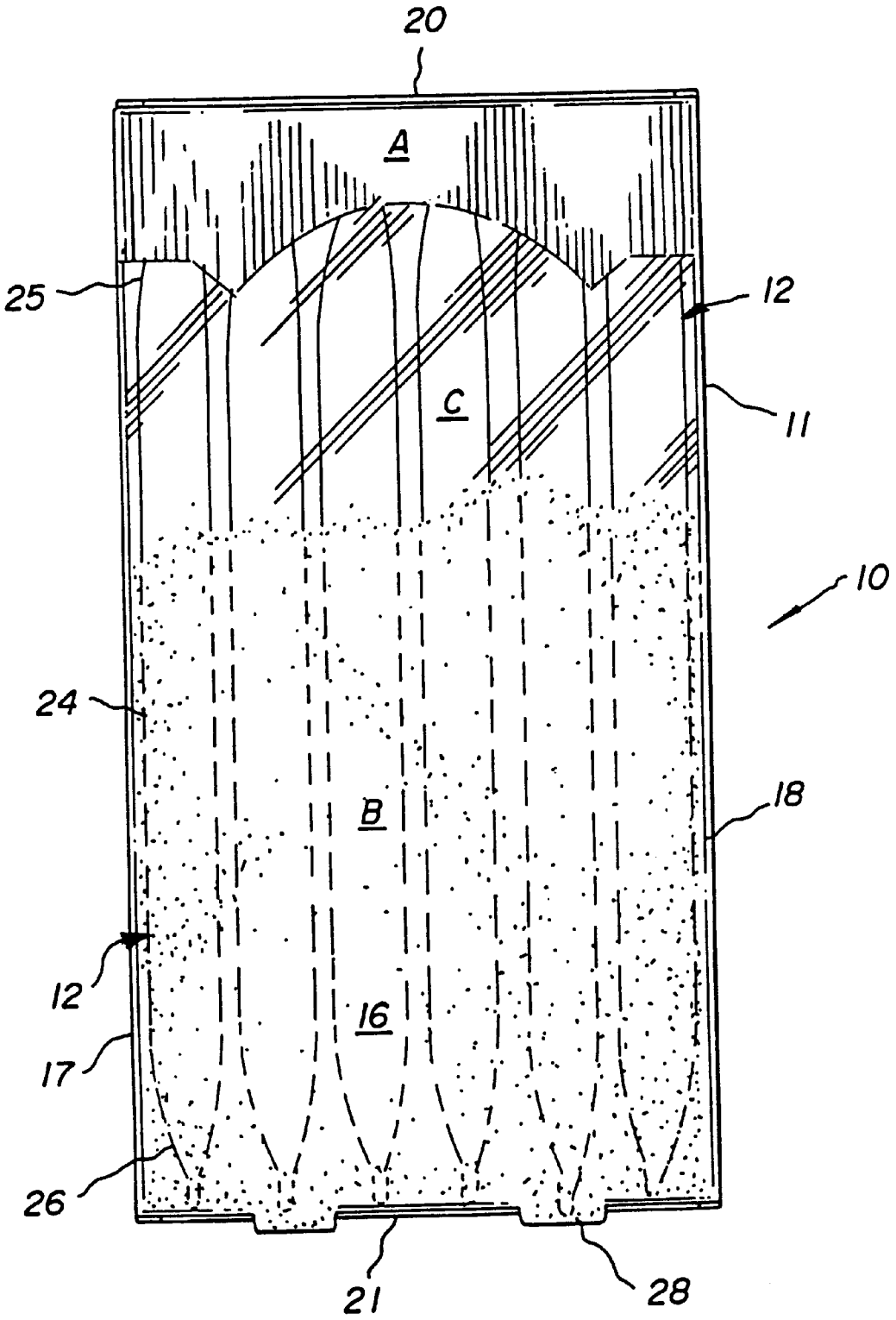
FIG. 4 is a rear elevational view of the package in accordance with the present invention.
Figure 6:
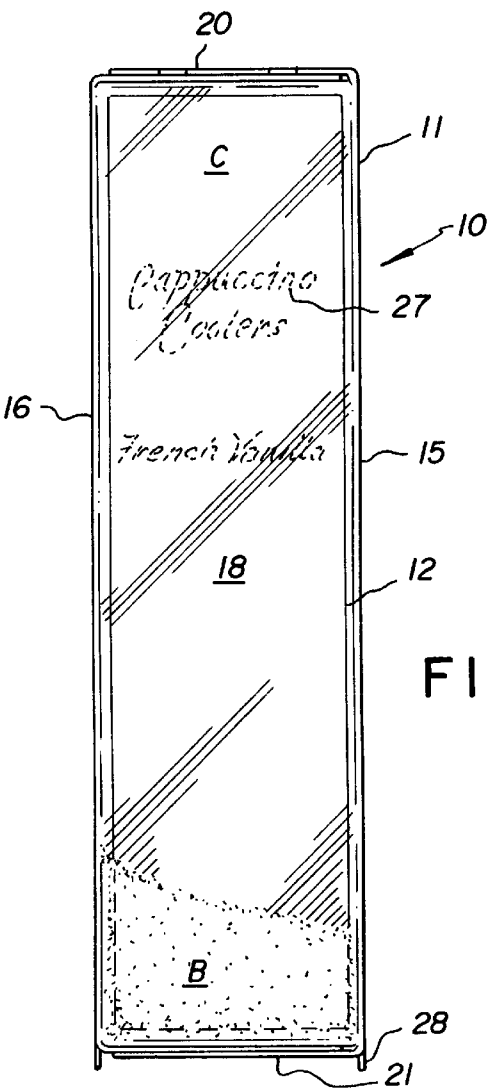
FIG. 6 is an elevational view of a second side of the package in accordance with the present invention.
Figure 5:
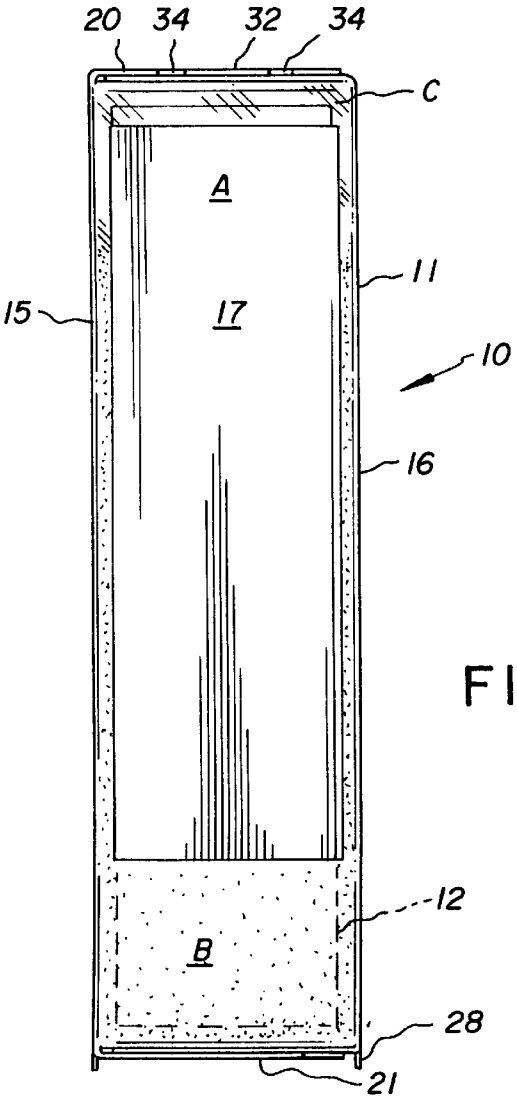
FIG. 5 is an elevational view of a first side of the package in accordance with the present invention.

Referring now to the figures, like elements are represented by like numerals throughout the several views.

As shown in the figures, the present invention comprises a display package 10 comprising an outer container 11 which houses a plurality of inner products 12. The outer container comprises a front 15, a back 16, a first side 17, a second side 18, a top 20 and a bottom 21. The package 11, including all of its surfaces are preferably constructed of a plastic material which is originally transparent but which in the present package is coated with materials of different opacities and different colors. The term "transparent" means an essentially clear, see-through material, although it can include some coloring in the material itself. "Translucent" means that the package material is coated with a layer of material which allows passage of sufficient light to make out the outlines of items inside the outer container. The term "opaque" means that essentially no light passes therethrough such that even outlines of items inside the outer container cannot be seen therethrough.

By providing coatings of different thicknesses and colors, there can be provided a unique outer container which is highly attractive and yet highly practical in that the placement of the coatings of different thicknesses can provide an attractive appearance, a background of opaque or translucent material for printed and pictorial material and provide clear areas for strategic visual access to the inner products 12 located therein. In the illustrated embodiment, the inner products are inner containers having a product indicia thereon and containing a product therein.

For example, in the illustrated embodiment, "A" represents areas of opacity, "B" represents areas of translucence and "C" represents areas of substantially complete opaqueness. Thus for example in the illustrated embodiment, the top 20 and the bottom 21 together with a border area along the top of the front 15 and back 16 can be formed completely opaque. The front of the package 15 can then include an opaque area for decoration and a translucent area thereabove. This provides a background for printed indicia and also permits the user to see at least the outline of the inner containers therethrough. In this embodiment the back 16 includes a lower translucent area which allows one to view the inner containers 12 and a transparent area toward the top of the back to allow clear visual access so as to see the inner containers and determine the number of containers remaining after the package has been opened and some inner containers have been removed.

In this preferred embodiment the first side 17 of the package may include any combination of transparency, translucence and opacity and include necessary indicia, including for example nutrition information. The second side 18 may be left substantially transparent to allow the user to view the indicia on an entire side of an inner container.

In the illustrated embodiment, the inner containers 12 are generally flat elongated packages having sides 24 terminating in tops 25 and bottoms 26. These generally flat inner containers cooperate with the outer container 11; for example the tops 25 of the inner containers are visible through the transparent area on the back 16 so that the number of packages in the outer container can be readily ascertained while the flat sides of the inner containers 12 cooperate with the essentially transparent second side of the outer container for viewing of the side of the inner container.

The outer container may include downwardly extending feet 28 along the bottom 21 thereof to facilitate the package 10 standing upright.

Figure 7:
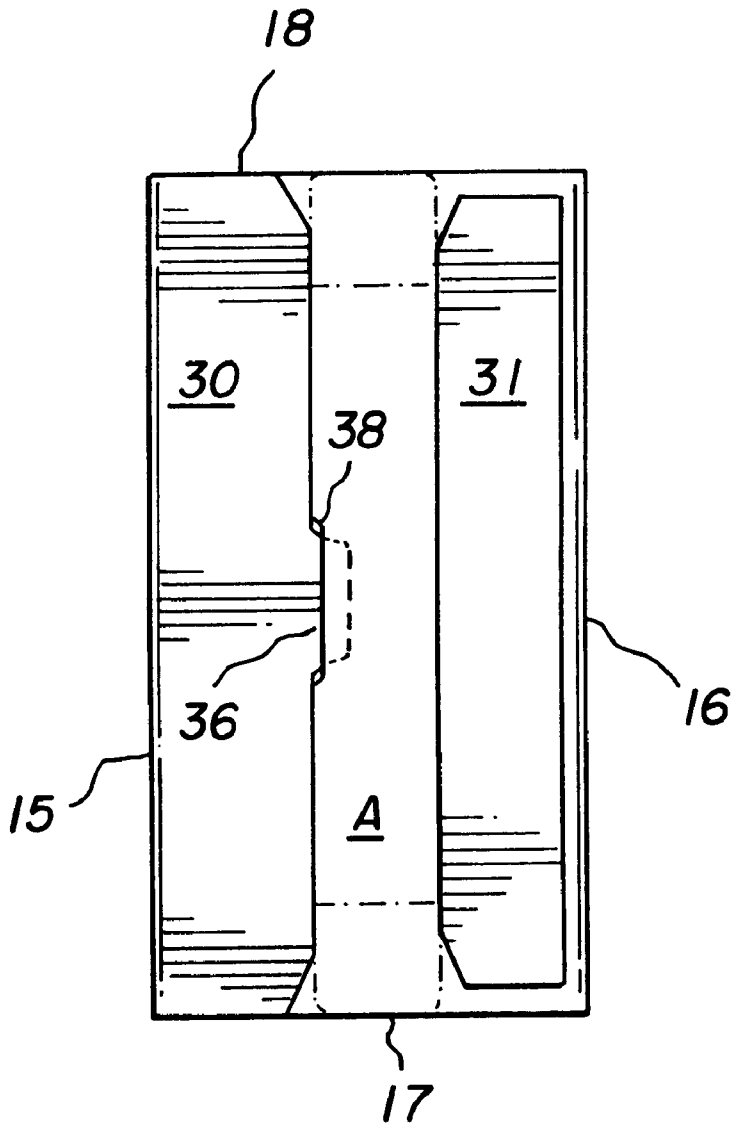
FIG. 7 is top view of the outer container of the present invention when reclosed, with a portion of one flap cut away.

The illustrated embodiment includes a preferred opening structure on the top 20. Specifically, this top includes first and second panels 30 and 31 connected across weakened lines to a tear-strip 32. The ends of this tear-strip include flaps 35 separated from the panels by cut-outs 34 to allow the flaps to be lifted to be pulled along the length of the weakened lines 33. The panel 31 includes a tongue 36 which can be used to reclose the package after it has been originally opened by removal of tear-strip 32. For example, FIG. 7 illustrates the top 20 after the tear-strip 32 has been removed and the package opened. Beneath the tear-strip, the panel 31 is integral with a flap 31*a* which extends the full width of the package below the panel 30. After the tear-strip is removed, the panel 30 is raised to one side while the combined panels 31 and 31*a* are raised in the other direction to gain access to the interior of the outer container. The large panel 31, 31*a* is then folded in, and the panel 30 is folded thereover with the tongue 36 engaging a closing slot 38 in the panel 31*a*.

It will be appreciated that the features of the present invention provide significant flexibility in designing an outer container having an attractive design and strategically located areas for viewing the inner containers without the need for complex manufacturing techniques as required to provide a viewing area in an opaque package. The invention permits a wide range of attractive designs utilizing coating materials of different thicknesses and different colors. For example, the translucency can change from blue to white to give a smoky effect or to give the effect of a transition from ice to water, and so on.

One preferred use of the present invention is for packaging a food product, wherein the inner containers each contain a single use product such as a powdered beverage product, each for making a single beverage serving. One application of the invention is for a beverage referred to as a "Cappuccino Cooler". The translucent areas can be colored blue and white with transitions between the colors, to provide visually a "cool" effect.

Although there is described herein a preferred embodiment of the present invention, it will be apparent that the invention is capable of numerous modifications and variations, apparent to those of ordinary skill in the art, without departing from the spirit and scope of the invention.

What is claimed is:

1. A package comprising:

an outer container comprising a transparent material;

a plurality of inner containers provided in the outer container and having indicia positioned on an outer surface thereof relating to a product within the inner containers, said outer container being at least partially coated to render at least a portion of the outer container substantially opaque or translucent such that a remaining transparent portion of the outer container corresponds to the position of the indicia on the inner containers, whereby when said inner containers are positioned in said outer containers, said indicia is at least partially visible through said remaining transparent portion of said outer container.

2. A package as claimed in claim 1 wherein the outer container has a top, a bottom and four sides and the transparent portion of the outer container forms a portion of at least one side of the outer container.

3. A package as claimed in claim 2 wherein the inner containers are positioned in the outer container such that said indicia is visible through said transparent portion of one side of the outer container.

4. A package as claimed in claim 3 in which the plurality of inner containers are positioned such that when one or more of said inner containers is removed from said outer container, the indicia of a product of one of said remaining inner containers will be visible through said transparent portion of one side of the outer container.

5. A package as claimed in claim 1 wherein the plurality of inner containers are positioned in said outer container such that all of the inner containers present in the outer container are visible through a transparent portion of said outer container.

6. A package as claimed in claim 5 wherein the outer container includes a top, a bottom and at least four sides, said sides having a length and a width, at least one of said sides being transparent over substantially the entire length and width thereof, the entire length of one inner container being visible therethrough.

7. A package as claimed in claim 6 wherein a second side of the outer container includes a transparent portion.

8. A package as claimed in claim 5 wherein the inner containers are positioned such that when one or more of said inner containers is removed from said outer container, the indicia on at least one of said remaining inner containers will be visible through said transparent portion of one side of the outer container.

9. A package as claimed in claim 8 wherein additional indicia relating to the product is present on at least one opaque portion of the outer container.

10. A package as claimed in claim 5 wherein the sides of the outer container are longer than they are wide to thereby provide an elongate container, and the inner containers are provided with sides and are adapted to stand within the elongate outer container by resting their sides against the elongate sides of the outer container.

11. A package as claimed in claim 10 wherein the inner containers are additionally provided with indicia on a side thereof and said inner containers are positioned within the outer container such that when one inner container is removed, the front face of another inner container will be visible through the transparent portion of the outer container.

12. A package as claimed in claim 1 wherein the outer container includes a bottom having feet which extend downwardly from the outer container to engage a surface when the bottom of the outer container is set down on a surface.

13. A package as claimed in claim 1 wherein the outer container includes opaque and translucent areas in its front and back, and wherein the inner containers are visible, at least in outline form, through said translucent areas.

14. A package as claimed in claim 13, including at least one transparent area in the front or back, through which all of the inner containers are visible.

15. A package as claimed in claim 14 wherein the inner containers comprise a plurality of elongated containers arranged upright within the outer container.

16. A package as claimed in claim 1 wherein the inner containers each contain a single food or beverage serving.

17. A display package comprising:

an outer container of a generally rectangular shape having a front, a back, and opposite sides, and formed of an originally transparent material, the front and back of the outer container coated to have opaque and translucent portions for package designs and indicia, a portion of at least one of the front or the back having a transparent viewing area, and at least one of the sides being substantially all transparent, a plurality of elongated inner containers arranged vertically within the outer container so as to generally fill the space between the sides, sides of the inner containers being visible through the transparent viewing area in the front or back and through the transparent side.

18. A display package as claimed in claim 17 wherein the front of the outer container includes a large translucent area through which the outline of the inner containers are visible.

19. A display package as claimed in claim 18 wherein the back of the outer container is mostly translucent, through which the outline of the inner containers are visible, and said transparent viewing area also located in the back of the outer container.

20. A display package as claimed in claim 17 wherein the outer container has an openable and closeable top for access to said inner containers.

21. A display package as claimed in claim 17 wherein the inner containers each contain at least one of a single food serving and a beverage serving.

* * * * *